US007633441B2

(12) United States Patent
Henderson et al.

(10) Patent No.: US 7,633,441 B2
(45) Date of Patent: Dec. 15, 2009

(54) STEERABLE ANTENNA AND RECEIVER INTERFACE FOR TERRESTRIAL BROADCAST

(75) Inventors: John G. N. Henderson, Princeton, NJ (US); Carl Scarpa, Plainsboro, NJ (US)

(73) Assignee: Hitachi America, Ltd., Tarrytown, NY (US)

( * ) Notice: Subject to any disclaimer, the term of this patent is extended or adjusted under 35 U.S.C. 154(b) by 0 days.

(21) Appl. No.: 11/839,202

(22) Filed: Aug. 15, 2007

(65) Prior Publication Data

US 2008/0089452 A1 Apr. 17, 2008

Related U.S. Application Data

(60) Division of application No. 11/346,643, filed on Feb. 3, 2006, now Pat. No. 7,425,920, which is a continuation of application No. 10/020,703, filed on Nov. 30, 2001, now Pat. No. 7,006,040.

(60) Provisional application No. 60/257,219, filed on Dec. 21, 2000.

(51) Int. Cl.
*H01Q 3/02* (2006.01)
*H01Q 3/12* (2006.01)

(52) U.S. Cl. ..... 342/359; 342/372; 342/374; 342/423

(58) Field of Classification Search ..... 342/359, 342/372, 374, 419, 423, 424, 427, 445; 343/757
See application file for complete search history.

(56) References Cited

U.S. PATENT DOCUMENTS 5,107,273 A * 4/1992 Roberts ..... 342/417
5,559,806 A * 9/1996 Kurby et al. ..... 370/325
7,009,559 B2 * 3/2006 Regnier et al. ..... 342/372

* cited by examiner

*Primary Examiner*—Dao L Phan
(74) *Attorney, Agent, or Firm*—Straub & Pokotylo; Michael P. Straub

(57) ABSTRACT

Antennas with steerable antenna patterns and techniques for using such antennas are described. In accordance with the invention, antenna patterns with one or more NULLs are used. Through the use of digital control signals the antenna pattern is steered so that a source of signal interference, e.g., a multipath signal, will be located in a NULL. In this manner the received signal's S/N ratio can be maximized thereby facilitating demodulation. The techniques of the invention can be applied to television, computer devices, mobile devices and a wide range of other systems. Digital commands to control an antenna may include multiple information fields, e.g., a direction field, a channel field, a gain field and a polarity field. Antennas incapable of supporting the specified fields disregard information in fields which are not supported. Information in each supported field is decoded and used to adjust the corresponding antenna characteristic.

11 Claims, 9 Drawing Sheets

STEERABLE ANTENNA AND RECEIVER INTERFACE FOR TERRESTRIAL BROADCAST

RELATED APPLICATIONS

The present application is a divisional of U.S. patent application Ser. No. 11/346,643, filed Feb. 3, 2006 now U.S. Pat. No. 7,425,920 which is a continuation of U.S. patent application Ser. No. 10/020,703 filed on Nov. 30, 2001 now U.S. Pat. No. 7,006,040 which claims the benefit of U.S. Provisional Application Ser. No. 60/257,219 filed Dec. 21, 2000, each of the preceding applications being hereby expressly incorporated by reference.

FIELD OF THE INVENTION

The present invention is directed to methods and apparatus for implementing and using antennas, and, more particularly, to methods and apparatus for implementing and controlling steerable antennas, e.g., for use in receiver devices such as television sets.

BACKGROUND OF THE INVENTION

Digital Vestigial Sideband (VSB) is the modulation format selected as the US terrestrial broadcast standard. As with all digital modulation formats, a critical aspect of receiver design is the handling of multipath, especially severe multipath interference combined with a marginal signal-to-noise ratio. The severity of the problem is maximized with indoor antennas used in urban environments. This is because, in urban environments, there are numerous buildings which tend to interfere with reception while also reflecting the transmitted signal leading to significant multipath interference. At present, multipath is handled by an equalizer in the demodulator portion of a receiver.

Despite recent improvements in equalizer design, signal reception under strong multipath conditions remains a technical problem confronting digital terrestrial broadcast.

In the context of satellite and analog television systems, various attempts have been made to improve reception by controlling one or more antenna characteristics. Unfortunately, such attempts have, for the most part, focused on satellite antennas or have generally ignored issues relating to multipath interference. Furthermore, such system generally ignore and/or issues relating to the receiver/antenna interface.

For example, U.S. Pat. No. 6,111,542 describes a user terminal including a rotating electronically steerable antenna system which combines coarse mechanical beam steering with fine electronic beam steering to provide full hemispherical coverage and enable hand-offs in a satellite communication system. Unfortunately, this reference fails to address issues relating to multi-path interference or to provide a simple control mechanism by which a digital receiver can automatically control multiple antenna characteristics.

The abstract of Published Japanese Patent Application 61296573 describes an adaptive antenna system which generates a steering signal based on an MSN algorithm implemented by a processor coupled to the antenna. The generated steering signal is used to adjust a directivity characteristic of an antenna element so that the major beam will be directed to the desired wave incoming direction even if the incoming direction of the desired wave is changed. As with the preceding reference, this reference fails to address issues relating to multi-path interference or to provide a simple control mechanism by which a digital receiver can automatically control multiple antenna characteristics.

U.S. Pat. No. 5,771,015 describes a system which relies on viewer input to select from a plurality of possible antenna settings. The described system includes a controllable antenna intended for indoor use as part of a television system. The system includes various electro-mechanical assemblies for controlling physical attributes of the antenna such as the orientation of antenna elements about a vertical axis, the length of antenna elements, the angular orientation of a loop antenna about a vertical axis, etc. Electrical attributes of the antenna such as the gain of variable gain elements can also be controlled. A viewer of the system selects what is perceived to be the optimum settings for a particular channel and the settings are stored for future use when the channel is selected. The described system has the disadvantage of relying on viewer input to determine the appropriate antenna settings. The need for such input results in a relatively complicated and non-user friendly control system. Furthermore, the specific problem of multipath interference is not addressed by the reference.

Given the challenges presented by multipath interference, there remains a need for antenna designs which are intended to eliminate and/or reduce the effect of multipath on received signals. In addition, while various systems have addressed controlling various physical and electrical characteristics of an antenna, there remains room for improvement in the way antennas are controlled. In particular, there is a need for improved antenna control methods which eliminate the need for viewer input. There is also a need for improvements in the number of antenna characteristics that can be controlled, and for improvements in the signaling techniques used to control antenna settings. Furthermore, in order to provide increased reliability and reduce manufacturing costs, it is desirable that the use of movable mechanical parts be reduced and/or eliminated at least in some embodiments.

SUMMARY OF THE INVENTION

The present invention is directed to methods and apparatus for implementing and controlling steerable antennas. Various embodiments of the invention are directed to antennas suitable for indoor use. Such antennas may be, e.g., incorporated into television receivers, e.g., to facilitate the reception of DTV signals. To reduce the effects of multipath interference, in various embodiments antenna patterns with one or more nulls are used. Aligning a null with a source of signal interference, e.g., a strong multi-path signal, the signal to noise ratio is improved resulting in an increased ability to demodulate and decode a received signal.

While the antenna control techniques of the present invention can be used with mechanically steerable antennas, to reduce the number of mechanical parts and to facilitate rapid redirection of the antenna pattern through the use of digital control signals, many embodiments of the invention are directed to antennas with electrically steerable reception patterns.

In accordance with various embodiments of the invention, the antenna pattern, e.g., it orientation, is directed by control circuits within a receiving device such as, for example, a demodulator and associated circuits, or by a similar device located in or coupled to the antenna. In accordance with the invention, the circuitry used to control the steerable antenna communicates with the antenna via digital signals transmitted over a digital bus.

The digital bus may be separate from the line(s), e.g., coaxial cable, used to couple the antenna elements to the receiver circuitry. Alternatively, the coaxial cable may be used as the bus in addition to the communications path by which signals received by the antenna are provided to the receiver circuitry.

From the users' standpoint, the steering can be automatic. Control can be effected, in accordance with the invention, by a one or two-way digital link. Use of a two-way link between the steerable antenna and antenna control circuitry provides for more advanced control functions, as compared to a one-way link. It also allows for the exchange of stored antenna characteristic information from the steerable antenna to the circuitry used to control the antenna.

In accordance with one feature of the invention, the antenna is implemented with an antenna pattern having one or more receiving directions characterized by relatively high reception "gain" and one or more other directions characterized by low gain ("nulls"). Low gain, e.g., null, antenna pattern regions may have, for example, a gain which is 6 dB or more down from the gain in a high gain antenna pattern region. The angular coverage of the "high gain" region (i.e., the number of degrees of arc over which the gain is substantially constant) is a function of antenna complexity and performance. However, antenna complexity does not affect the general concept of the present invention, as long as it is possible to steer the high gain condition to the various directions in which reception is to be supported, e.g., around a full circle of coverage in various embodiments.

The control signal used to control the antenna is derived, in various embodiments, by analysis of various aspects of the received signal such as, e.g., signal-to-noise ratio, multipath, other interference, etc. Measurements of such aspects of a signal are often inherent in digital demodulation making them well suited for use in antenna control while adding relatively little additional cost or complexity to a digital receiver.

The digital control signal can easily provide for many more antenna states than are necessary or practical for a low-cost antenna. While the number of antenna pattern positions which are supported may be important to performance in some embodiments, the present invention does not require any specific number of antenna pattern positions but rather only that multiple antenna pattern positions be supported.

In some embodiments, the optimum antenna pattern position is determined by emphasis on achieving the highest antenna gain. Such an antenna position control approach is useful where, e.g., addressing low signal power is an important, or the only, reception issue. In other embodiments where multipath or other signal interference is an important factor, the position of the antenna pattern is steered to position a reception "null" facing the direction of the multipath signal or other interference. More advanced control techniques, which may be used in accordance with the invention, involve consideration of a plurality of factors in determining the optimum antenna pattern position.

In various embodiments, in addition to a controllable antenna pattern position, a pre-amplifier associated with the antenna has its gain adjusted under the control of signals received via the control bus. Antenna pre-amplifier adjustments may depend, for example, on signal level and the presence or absence of other strong signals that might overload the amplifier.

In some embodiments, in addition to antenna position and gain adjustments, adjustments in antenna polarization are also supported. Antenna polarization is selected, e.g., in embodiments which use an antenna which provides, e.g., more than one horizontal and/or vertical polarization.

Various embodiments of the invention are intended for use in consumer devices such as television receivers. For such embodiments, for cost reasons, fairly simple antenna patterns, gain and polarization adjustments are described and used. However, the same concepts and features apply to more complicated and expensive antennas which can also be implemented in accordance with the invention. Likewise, the control bus of the present invention and control signals are intended to be simple and of relatively low speed, for reasons of cost and control of radiation from the digital signals on the bus. However, faster and more elaborate control signals are also possible and within the scope of the present invention.

Although the present application is directed towards digital television, terrestrial broadcast signals, and their demodulators, the general principles of a steerable antenna controlled by analysis of the received signal apply to other digital signals such as, analog TV, radio and other signals. Furthermore, the antenna control techniques of the present invention can be used in mobile as well as stationary devices.

Although various features of the present invention are described in the context of exemplary embodiments which use electrically steerable antenna patterns, the signaling and control methods of the present invention, including the antenna control interface, can be used in conjunction with mechanically steerable antennas, e.g., one mounted on a rotor.

DETAILED DESCRIPTION

As discussed above, the present invention is directed to methods and apparatus for implementing, using, and controlling steerable antennas.

While not limited to indoor applications, the methods and apparatus of the present invention are particularly well suited for implementing indoor receivers, such as television sets, which use indoor antennas.

Figure 1:
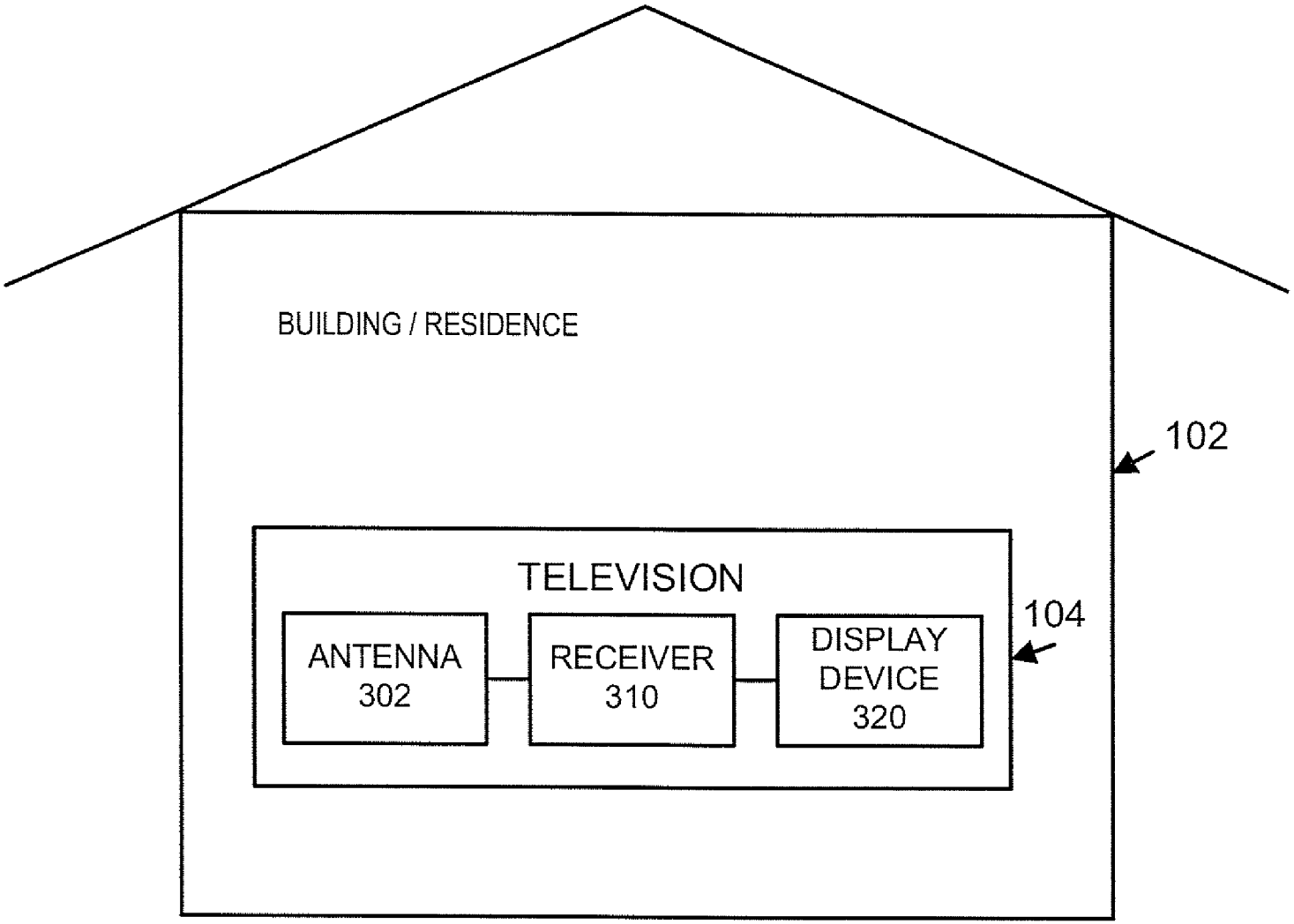
FIG. 1 illustrates a building having a television set implemented in accordance with the present invention located therein.
Figure 9:
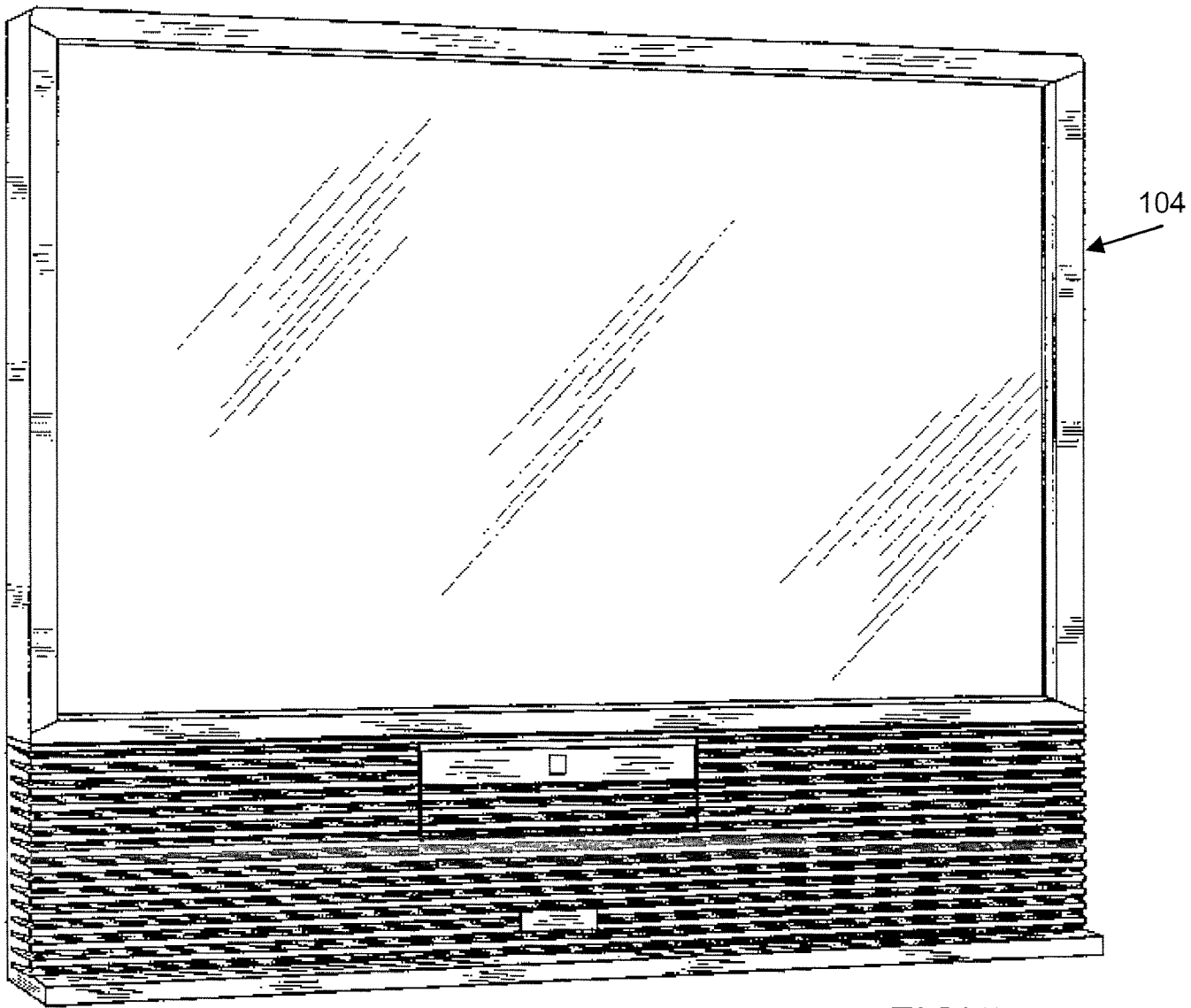
FIG. 9 illustrates an exemplary television set incorporating the novel antenna and receiver features of the present invention might appear as viewed from the front.

FIG. 1 illustrates a television receiver 104 implemented in accordance with the present invention. The television 104 includes an antenna 302, a receiver 310 and a display device 320 which are coupled together as shown in FIG. 1. The television 104 is an indoor device as indicated by its location inside a building 102. The building 102, may be e.g., a residence such as a home or apartment. FIG. 9 illustrates how an exemplary television 104, incorporating the features of the present invention, might appear when viewed from the front of the television.

As will be discussed in detail below, the antenna 302 receives and supplies broadcast signals to the receiver 310. In addition the antenna 302 and receiver 310 interact so that the antenna pattern of the antenna 302 is steered under the control of the receiver 310 as a function of the signal to be received and/or signal interference which may be encountered. In addition to the direction of the antenna pattern other antenna characteristics may also be controlled by the receiver 310. Receiver 310 demodulates and, optionally, decodes, signals received from the antenna 302. The resulting signals are supplied to the display device 320. In addition to generating the signals to be displayed, the receiver 310 is responsible for generating the antenna control signal or signals used to control the antenna 302.

Figure 7:
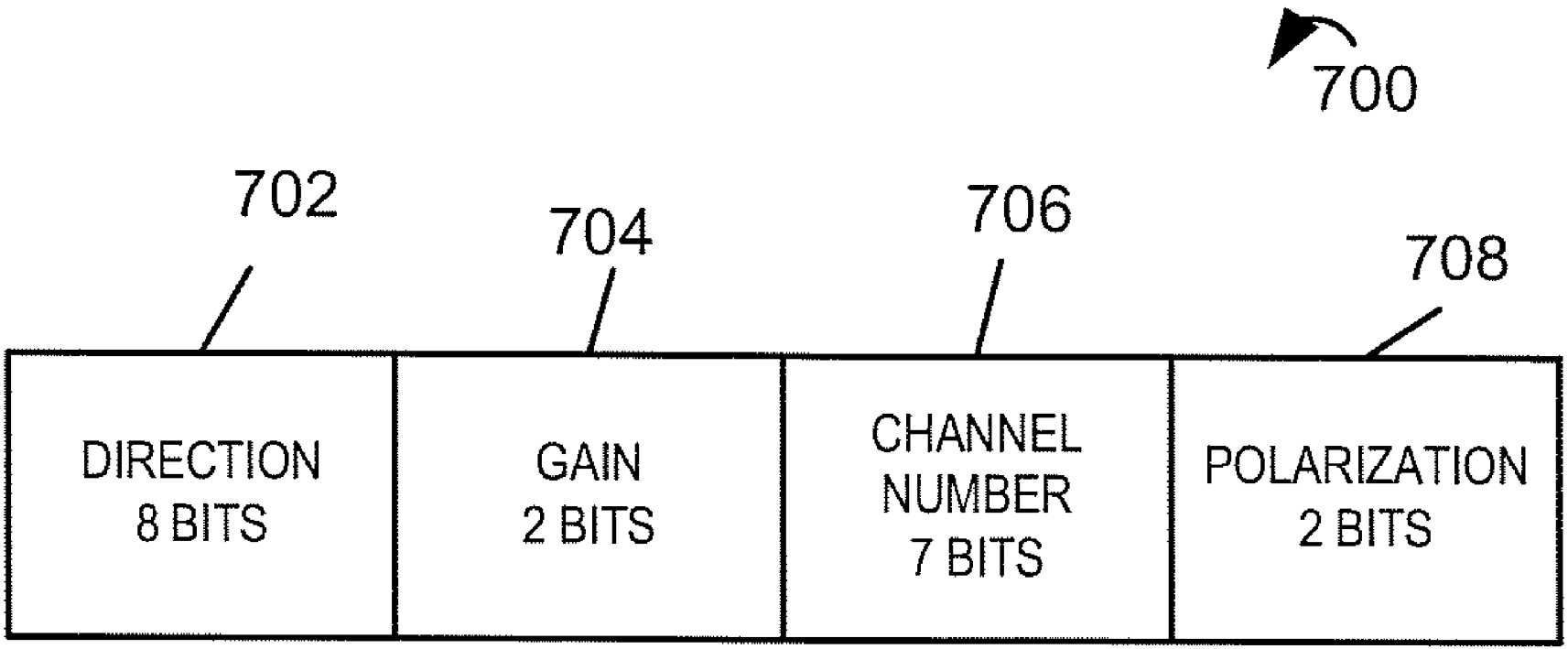
FIG. 7 illustrates an exemplary multi-bit digital control signal which can be used to control an antenna in accordance with the present invention.

FIG. 7 illustrates an exemplary digital antenna control signal 700. The signal 700 may be generated by the receiver 310 and supplied to the antenna 302 in accordance with the present invention. As illustrated the exemplary control signal 700 includes direction, gain, channel number and polarization control values 702, 704, 706, 708, respectively. Eight bits 702 are used to control the direction of the antenna pattern. Two bits 704 are used to control the gain of an amplifier in the antenna 302. Seven bits 706 are used to specify the number of the channel, e.g., television channel, to be received. Another two bits 708 are used to specify antenna polarity. Fewer or more bits than those shown in FIG. 7 can be used to control various functions and, in cases where all control functions are not supported, some bits may be omitted. For example, in the case of antennas which do not support adjustable polarity the two bits 708 used to specify antenna polarity may be omitted from the control signal or, alternatively, disregarded by the antenna 302. While eight bits 702 are shown as being used to support direction control, when fewer than $2^8$ positions are supported, less than 8 bits may be used to specify direction.

As discussed above, in urban environments, multipath signals resulting from reflections off nearby buildings can make it particularly difficult to demodulate and decode a transmitted signal. One feature of the present invention is directed to an antenna with an electrically steerable pattern. For purposes of being able to reduce the effect of interference from a particular direction, it is desirable that the utilized relatable antenna pattern have relatively deep nulls located at one or more points.

Figure 2:
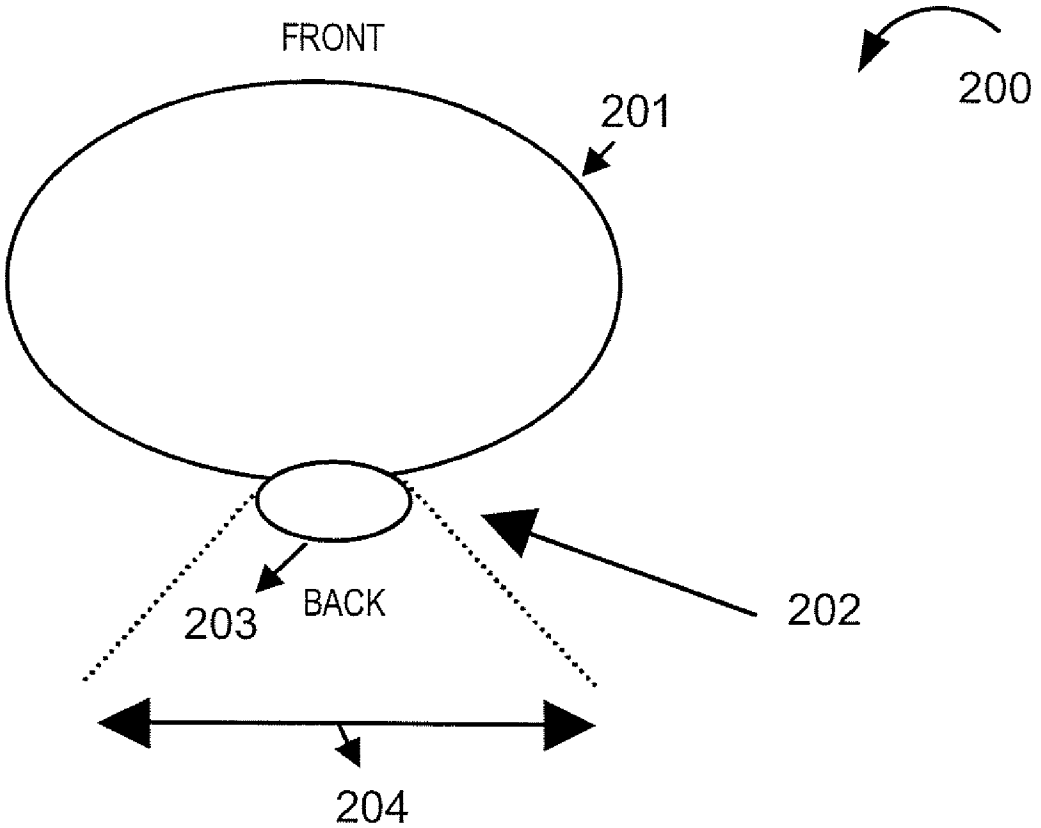
FIG. 2 illustrates an exemplary antenna pattern which may be used in accordance with the present invention for implementing a steerable antenna.

An example of a suitable antenna pattern for use in accordance with the present invention is a cardioid 200, such as the one shown in FIG. 2. As illustrated the cardioid antenna pattern includes a large main lobe 201 located to the front of the antenna pattern 200, a small rear lobe 203 and deep nulls 202. In the FIG. 2 diagram, the larger the antenna pattern lobe, the stronger will be the reception in the area corresponding to the lobe.

In the case of strong multipath or other interference, steering of the antenna pattern 200 involves moving the pattern's nulls 202 to minimize multipath and/or other interference. In the case of strong interference, this can be preferable to steering the main lobe 201 to maximize signal strength. The pattern 200 of FIG. 2 provides a broad main lobe 201 in addition to well-defined nulls 202 and/or the region of attenuation 204.

The cardioid pattern of the antenna 302 rotates under control of the receiver 310. Continuous rotation may be supported but is not required. Four discrete positions (e.g., north, south, east, west) may be sufficient for many applications. However, finer rotational control is likely to provide better results.

The exemplary pattern shown in FIG. 2 uses a pattern with a large front-to-back ratio for an inner city multipath environment. While not being inconsistent with the invention, a steerable single dipole pattern is probably not as good as the suggested cardioid in the case of multipath conditions due to the lack of a large front to back ratio. Use of other patterns than the one shown in FIG. 2 is possible and contemplated as being within the scope of the invention.

Figure 3:
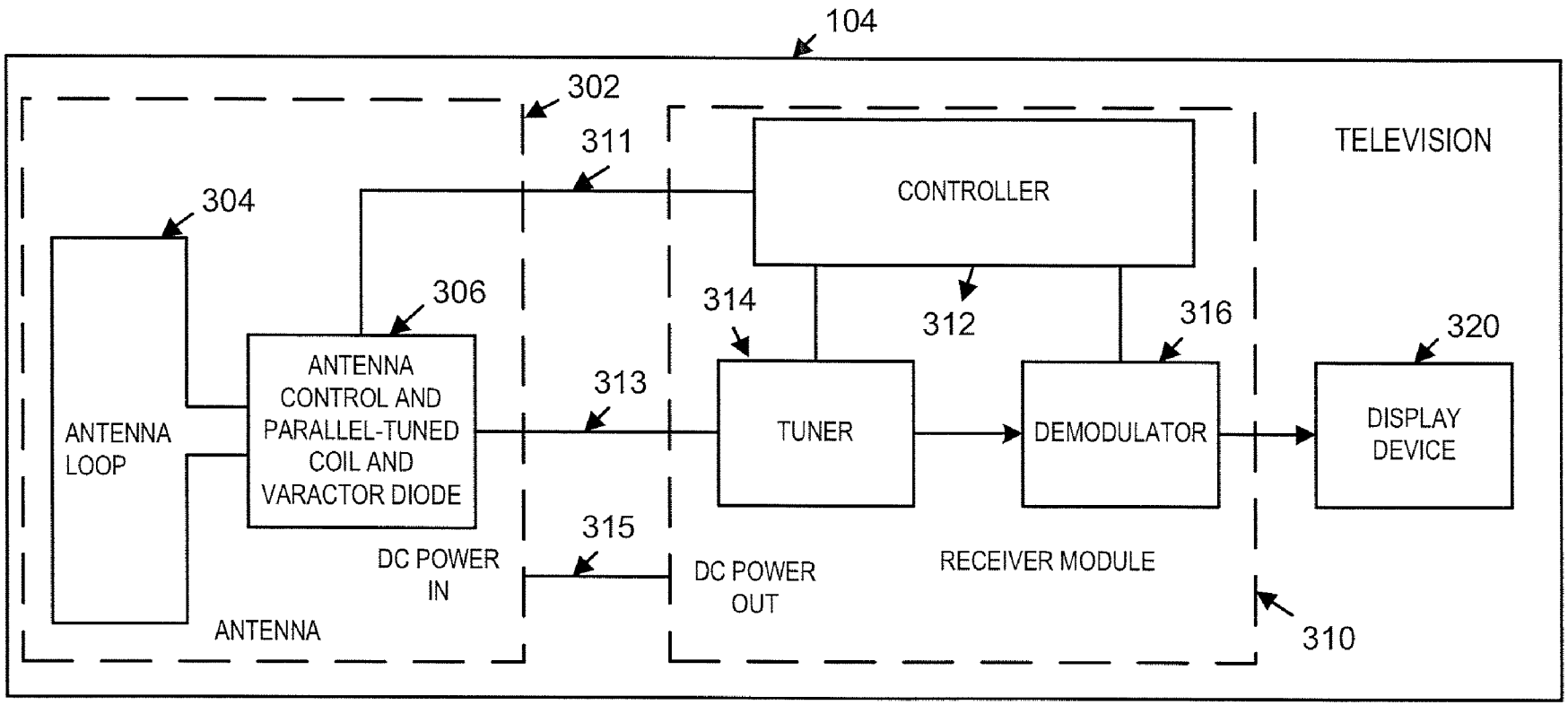
FIG. 3 illustrates the television of the present invention shown in FIG. 1 in greater detail.

The exemplary television 104 of the present invention shown in FIG. 1 is illustrated in greater detail in FIG. 3. In particular, FIG. 3 shows exemplary contents of the receiver 310 and antenna 302 which are coupled to the display device 320. The receiver 310 receives/sends information and control signals over a bus 311. In addition, signals from the received by the antenna 302 are communicated to the receiver via co-axial cable 313. DC power is supplied from the receiver to the antenna via a power supply line 315.

The receiver 310 includes a controller circuit 312, a tuner 314 and a demodulator 316. The tuner performs various filtering and equalization operations on the received signals supplied by the antenna 302. After processing of the received signal by the tuner, the received signal is subject to demodulation and/or decoding prior to being supplied to display device 320. Demodulator 316 is responsible for performing the demodulation operation on the received signal and for generating various signal measurements which are used by the controller 312 in generating the antenna control signals. The signal measurements may include, e.g., signal amplitude, signal to noise level (S/N) and other measurements, e.g., various channel condition estimation measurements. While a demodulator is shown in FIG. 3 as the device making the signal measurements from which antenna pattern position control signals are based, signal demodulation is not required in all embodiments and relatively simple circuitry may be used in place of a demodulator for making such signal measurements. For example a received signal could be processed by a rectifier and then subject to amplitude measurements with the resulting measurements then being used to control antenna pattern position.

In FIG. 3 the control signal generated by the controller 312 is transmitted to the antenna 302 over a stand alone communications link, e.g., bus 311, or by way of tuner 314, over the same line, e.g., co-axial cable 313, used to supply the received signal from the antenna 302 to the receiver 310.

The antenna 302 is responsive to the control signal or signals received from the receiver 310. The antenna 302 includes an antenna loop 304 which is coupled to an antenna control and parallel tuned coil and varactor diode circuit 306. The tuned coil varactor diode circuit 306 is optional, and omitted in some embodiments, e.g., in a exemplary UHF TV antenna embodiment. The circuit 306 communicates with the controller 312.

The antenna loop 304 may be small in size. However, even with an electrically small size the antenna loop can achieve adequate bandwidth for many receiver applications without being deliberately lossy. In the context of a television receiver embodiment, where 6 MHz is allocated per television channel, the "full-gain" bandwidth will normally correspond to at least one TV channel, e.g., 6 MHz.

As will be discussed further below with reference to FIG. 4, the antenna control and parallel tuned coil and varactor diode circuit 306 provides tuning if necessary or helpful to maximize the delivered signal level and/or S/N ratio. A single-tuned L-C circuit maybe adequate for use in the circuit 306. The tuned L-C circuit may comprise, e.g., a coil and varactor diode combination at the antenna terminal where it feeds into the co-axial cable or twin-lead.

The dc voltage for controlling the varactor diode is generated in the antenna 302. The receiver 310 provides channel number information as part of the control signal 700, but it need not provide the actual dc voltage used to control the varactor diode since this voltage will be generated locally. This is so that the antenna 302 and the tuner 314, which may be purchased separately, do not need matching voltage-versus-frequency characteristics. As will be discussed with regard to FIG. 4, the antenna 302 includes circuitry to translate the channel number to a suitable dc voltage of sufficient accuracy and resolution for antenna tuning.

Figure 4:
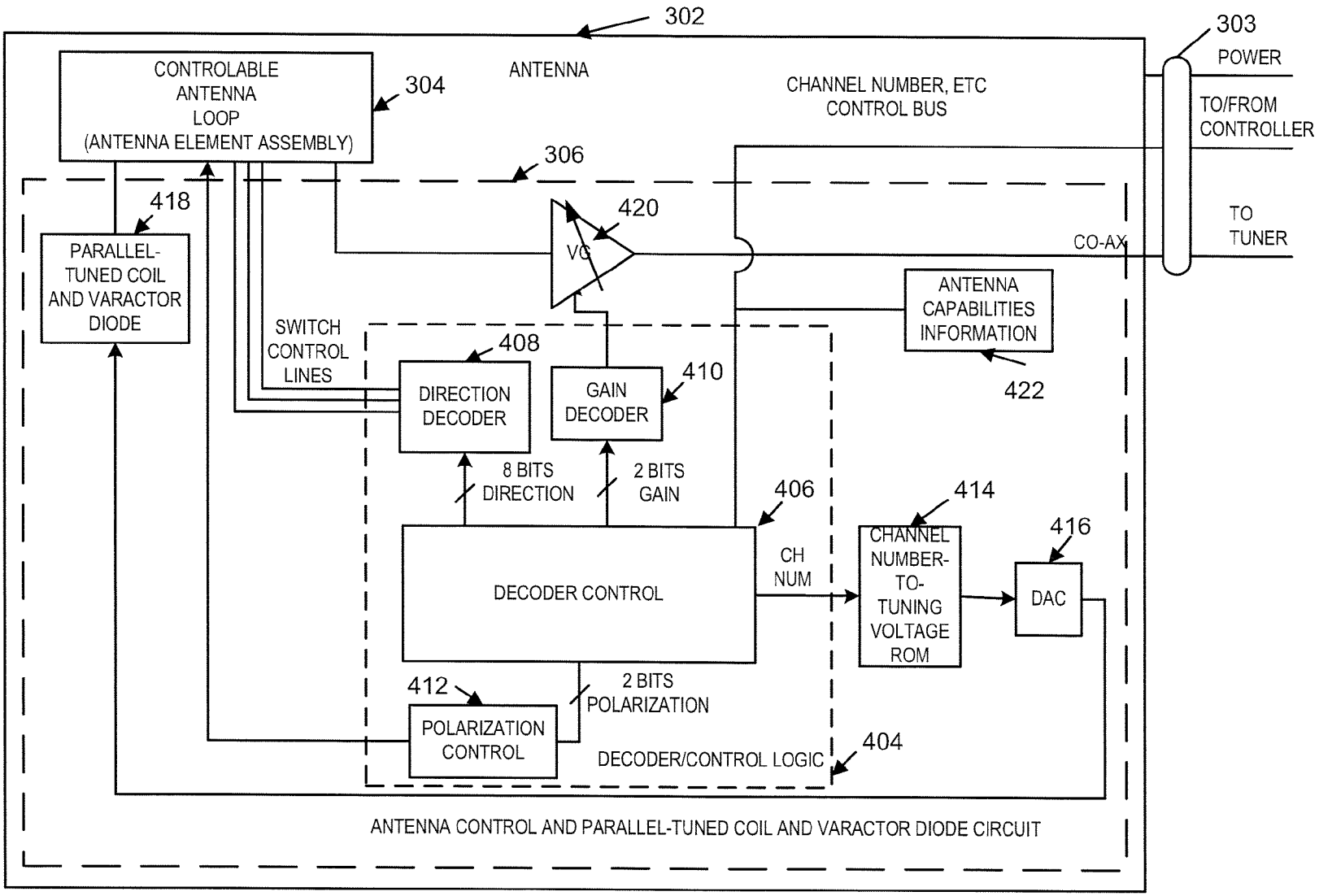
FIG. 4 illustrates the exemplary antenna used in the exemplary embodiment shown in FIG. 3.

FIG. 4 illustrates an exemplary antenna 302. The antenna 302 includes the controllable antenna loop 304 and the antenna control and parallel-tuned coil and varactor diode circuit 306. A connector 303 is used to connect the power supply line, control bus, and antenna output (co-axial cable) to the receiver.

Circuit 306 includes a decoder/control logic circuit 404, channel number-to-tuning voltage ROM 414, Digital to Analog Converter (DAC) 416, parallel-tuned coil and varactor diode 418, variable gain signal amplifier 420, and antenna capabilities information 422.

The decoder/control logic circuit 404 is responsible for receiving and parsing antenna control signals to generate individual signals used to control each of the adjustable antenna characteristics. Decoder/control logic circuit 404 includes decoder control 406, direction decoder 408, gain decoder 410, and polarization control 412.

The decoder control circuit 406 is responsible for initial parsing of received control signals. Assuming receipt of the exemplary control signal shown in FIG. 7, the decoder control circuit 406 will extract the data in each of the control fields 702, 704, 706, 708 and supply them to the corresponding decoder or control circuit.

For example, the 8 bits corresponding to direction control will be extracted from a control signal by decoder control circuit 406 and supplied to the direction decoder control circuit 408.

The direction decoder circuit 408 interprets the 8 bit direction signal and generates antenna loop switch control signals to implement the direction instruction. The switch control signals are supplied to the controllable antenna loop 304 and are used to control switches included therein which determine antenna pattern direction.

Figure 6:
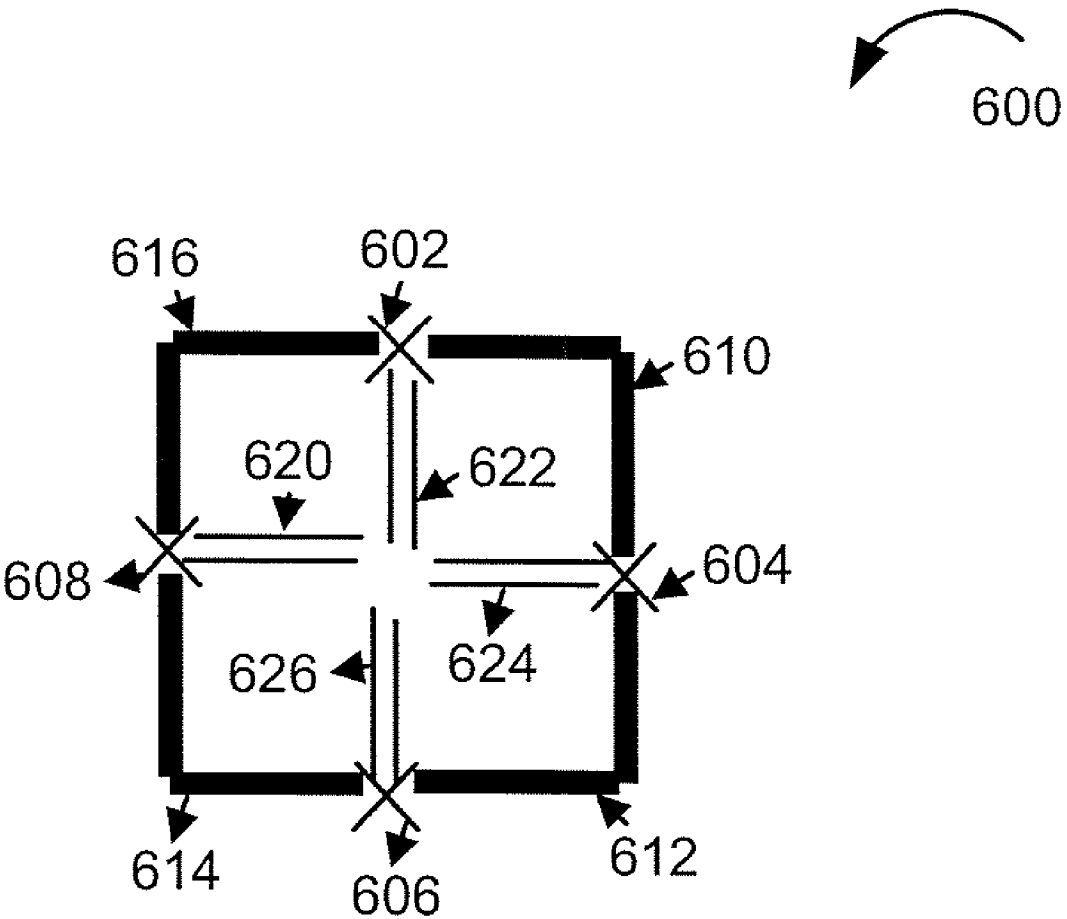
FIG. 6 illustrates an exemplary steerable antenna that may be used with the present invention.

An exemplary antenna structure 600, e.g., controllable antenna loop, which uses PIN diodes 602, 604, 606, 608 as controllable switches, is shown in FIG. 6. FIG. 6 is a conceptual drawing provided for purposes of explanation. In an actual implementation, the actual antenna configuration, number of gaps, etc. may look and be different as long as it allows for antenna pattern steering in accordance with the invention. As shown in FIG. 6, the antenna 600 comprises four elements, 610, 612, 614, and 616. PIN diodes 602, 604, 606, and 608 are located at each of the gaps. The PIN diodes 602, 604, 606 and 608 are coupled to the direction decoder circuit 408 by control lines 622, 624, 626, 620 respectively. Antenna steering is accomplished by supplying one of the antenna loop switch control signals generated by the direction decoder circuit 408 to each of the PIN diodes which serve as switches. Opening or closing these switches in controlled combinations can steer the antenna pattern.

In various implementations of the lines 620, 622, 624, 626 used to supply control voltages to the PIN diodes are arranged to have minimal impact on the antenna pattern, or the effects of the control lines are included in the pattern design.

Referring once again to FIG. 3, the receiver 310 sends a signal instructing the indoor antenna 302 to move its pattern to another location, at point in time determined by the controller 312. The receiver 310 does not affect the steering/switching controls directly but through the direction decoder circuitry 408 included in the antenna. The control signal 700 from the receiver 310 is delivered on a digital bus. A serial bit stream can be implemented with adequate speed and can be used as a cost-effective way to supply the control signal 700 to the antenna 302. As illustrated in FIG. 4, the mapping of the receiver's steering instructions to actual PIN diode control signals is the responsibility of the antenna 302.

The direction instructions from the receiver 310 can take the form "move to the next possible position in a clockwise/counterclockwise direction", or there could be unique codes for the available antenna positions. In the case where unique codes are used for each antenna position, the receiver 310 issues an instruction to move to a particular position.

Figure 5:
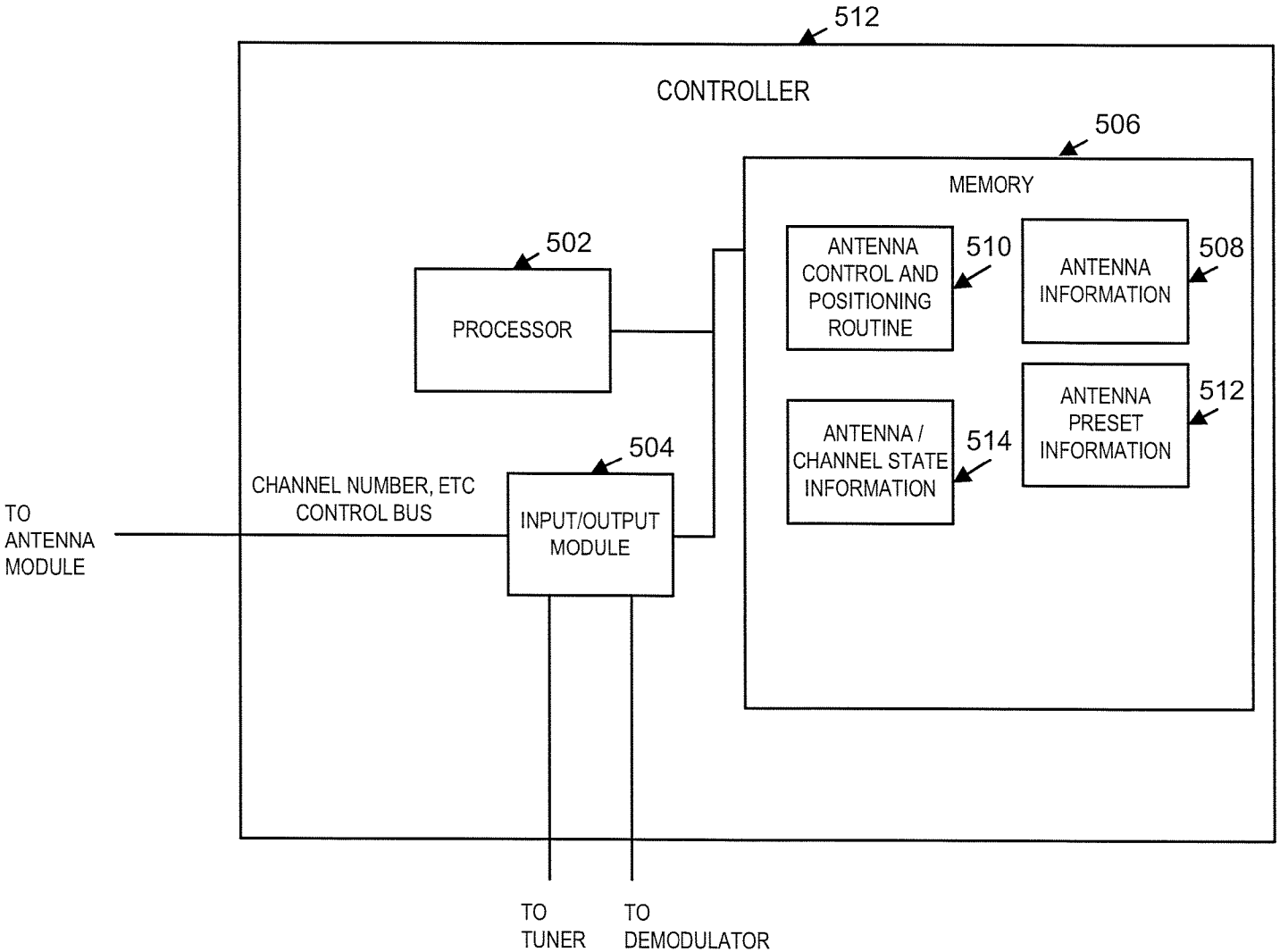
FIG. 5 illustrates the controller of the present invention shown in FIG. 3, in greater detail.

The receiver 310 is responsible for searching for and identifying the optimum position under the direction of an optimum antenna positioning routine 510 (See, e.g., FIG. 5). The antenna and receiver communicate via an established protocol how many positions are available in one complete revolution of the pattern, the estimated switching time, etc.

The receiver 310 may have possible codes for more positions than are supported in the actual antenna 302. If so, and if the receiver's search for an optimum position eventually directs the antenna to a state more "fine-grained" in position than the antenna actually offers, then the antenna's direction decoder 408 selects the closest available position automatically. Thus, position resolution can also be calculated in the receiver 310 even if the antenna 302 doesn't inform the receiver 310 of the number of available states it supports. The number of positions an antenna supports, along with information about the antenna's other capabilities is stored in a block of memory 422 in the antenna 302. The antenna capabilities information 422 is communicated to a receiver 310 when the antenna 302 is first connected to the receiver 310 or whenever requested by the receiver module as discussed below.

Referring once again to FIG. 4, it can be seen that in addition to supplying the bits used for controlling antenna pattern direction to the direction decoder 408, the decoder control 406 supplies the 2 bits from a received control signal used to control gain to the gain decoder 410. In addition it supplies the 7 bits representing a channel number to the channel number to tuning voltage ROM 404. The two bits of the control signal 700 used to control antenna polarization are supplied to polarization control circuit 412.

The gain decoder 410 converts the 2 bit gain control signal into a voltage level which is used to control the gain of variable gain element 420. Accordingly, the gain applied to the signal received by the antenna can be controlled by the receiver 310 through the use of control signal 700.

Channel number to tuning voltage ROM 414 is implemented using a channel number to voltage look-up table. For a given channel number input, the ROM 414 will output the appropriate tuning voltage as indicated by the contents of its look-up table. Digital to analog circuit 416 converts the digital voltage value output by ROM 414 to an analog voltage signal which is used to control the parallel-tuned coil and varactor diode circuit 418 so that it is properly tuned for the channel to be received.

Antenna polarization is controlled by the two bits of the control signal 700 that are supplied to the polarization control circuit 412. The polarization control circuit 412, in response to the received control bits, generates a switching control signal that is supplied to the controllable antenna loop 304 to control antenna polarization. In many embodiments, antenna polarization control is not supported and polarization control circuit 412 is omitted in such embodiments.

In order to minimize the number of wires between the indoor antenna and receiver 310 and the number of pins on the connector(s), communication is accomplished in some embodiments through the use of a self-clocking serial bus 311. In addition to this bus 311 there will be the co-axial cable 313 (or twin lead). In some embodiments, a dc power line from the receiver 310 to the antenna 302 will also be included.

In cases where the antenna 302 supplies antenna information, e.g., position or capabilities information, to the receiver 310 a two-way bus 311 is used. However, in less advanced implementations where the antenna does not send information to the receiver 310, a one-way bus is used.

Signals from the receiver 310 to the antenna may include, e.g.: 1) instructions to move the antenna to a different pattern position; 2) channel number information; and 3) other controls for pattern or gain depending on the implementation. Signals from the antenna to the receiver may include, e.g.: 1) information about the number of available pattern positions; 2) information about the speed of moving patterns (e.g., to allow for inclusion of mechanically steered antennas in this plan); 3) other information if available and/or needed.

The serial bus 311 carries digital signals, which radiate some amount of electrical noise into the antenna loop 304 and thus into the tuner 314. The wires are arranged to minimize pick-up of such noise. Some embodiments may have high-pass filters in the signal leads to reduce the noise further. In other embodiments, it is possible to effect some control of the rise-time of the edges of the signals sent from the receiver 310 and antenna 302.

The functions that are controlled by the receiver 310 include antenna pattern direction, antenna pre-amplifier gain, and antenna polarization. An antenna 302 is not required to implement all of these functions. In some embodiments antennas decode the instructions that it is capable of following and ignore the others. For example, a small indoor antenna may not have the ability to change polarization. Control signals from the receiver 310 to the antenna are considered "upstream," while signals from the antenna 302 to the receiver 310 are considered "downstream".

Although not required, the antenna 310 may have the ability to inform the receiver 310 when it has reached the new state to which it has been directed. Such a feature is useful when mechanical rotation of an antenna is used. This is because mechanical rotation takes different amounts of time to achieve the desired state depending on the amount of rotation to be performed. this makes it useful to receive a notification when the rotation has been completed. The antenna 302 may also inform the receiver 310 about the functions it is capable of implementing, the number of directional states it can resolve, etc., by sending the information stored in block 422 to the receiver 310.

The upstream states and examples of the associated numbers of bits allocated in a control message are:

Direction:

In one embodiment, the bit stream can devote as many bits as practical to controlling the directional pattern, e.g., 8 bits, or 256 unique directional states, is an exemplary maximum for consumer products. Not all antennas will have 256 unique states, and simpler antennas will respond only to the higher order bits, e.g., defining 8 unique states by using only the 3 most significant bits.

Pre-amplifier Gain:

In one embodiment, the bit stream can devote 2 bits to controlling gain of the pre-amplifier. The four states are: 1) pre-amplifier OFF; 2) low gain; 3) mid-level gain; 4) maximum gain.

Polarization:

In one embodiment, the bit stream can devote 2 bits to polarization, to enable horizontal, vertical, or circular polarization, if available in the antenna.

Channel Number:

In one embodiment, the bit stream devotes 7 bits to inform the antenna 302 of the channel selected. Use of these bits by the antenna 302 is optional. They are provided to enable band switching or tuning functions, if desired.

The downstream states and the associated numbers of bits are:

State Achievement:

In one embodiment, the antenna 302 informs the receiver 310 that it has reached the new state, e.g., position, to which it has been directed. One bit is sufficient for this function. This function will be most useful for slow-moving antenna pattern changes, such as those achieved with a motor and mechanical motion of the antenna. Electrically-steered patterns move more quickly and may not need this signal.

Antenna Functionality:

In one embodiment, the antenna 302 informs the receiver 310 what functions it is capable of implementing. For example antenna 302 describes the number of states it supports for each of the above antenna functions. In one embodiment, 8 downstream bits tell the receiver 310 how many directional states will actually be used, 2 additional bits are used to indicate the number of available gain states, and 2 more bits specify the available polarization states if any. This information is held in block 422 of the antenna 302 and is transmitted to the receiver 310, e.g., at power up or when requested.

Information from the antenna 302 to the digital receiver 310 is sent very infrequently, and, in some embodiments, only at the request of the digital receiver 310. For example, the information can only be sent for initialization at the first connection, and thereafter it can be stored in the receiver 310, e.g., in memory block 508. Alternatively, it could be sent each time the receiver 310 and antennas 302 are turned on. This procedure minimizes any effects of signal radiation and interference from the control bus 311.

The interface and the coding between the antenna 302 and the receiver 310 can include:

1) Low Complexity and Low Speed

In one embodiment, the interface uses a serial bit stream on single wire bus 311. The interface is bi-directional, enabling state information to be relayed from the antenna 302 to the receiver 310 and control information to be transferred from the receiver 310 to the antenna 302. A one-wire interface can provide both "upstream" and "downstream" directions of information flow. In addition, the single wire can provide DC power from the receiver 310 to the antenna 302. In one particular embodiment the RF signals containing the received TV signals are also carried on this single wire.

The serial information is sent at a <9 KHz bit rate to minimize RF interference into the DTV receiver's tuner 314. The control and information bit stream is turned off unless the receiver 310 is actually changing the antenna state or receiving antenna information. Thus, during normal program viewing, the digital antenna control and information signals do not exist.

The code used to communicate antenna control signals and antenna information is self-clocking for simplicity, to effect synchronization easily between receiver 310 and antenna 302, and to minimize the frequency of all components.

2) No DC Component

In one embodiment, the serial bit stream is desirably coded so that there is no DC component. This enables the wire to carry a DC voltage to power the antenna without disrupting the communications channel used to transmit antenna control signals and information.

3) Standard and Simple Technology

In one embodiment, the code used to transmit antenna control and information signals is a well-known Manchester code, for which standard algorithms and simple encoder and decoder implementation are available.

The controller 312 of receiver 310 is responsible for implementing the antenna control method of the invention. As illustrated in FIG. 5, the controller 312, which may be implemented as a microprocessor, includes a processor 502, input/output module 504, and memory 506. Memory 506 includes antenna information 508, antenna positioning and control routine 510, and antenna preset information 512. Memory 506 includes a block of memory 514 used to store an antenna state information associated with each channel. Thus the receiver 310 may include sets of antenna information for each channel. Different sets of state information may be stored for each of a plurality of different antennas. In the antenna 302, there need not be a priori compass direction information—the receiver 312, under direction of the antenna control and position routine 510 searches the circular (or spherical) antenna space without regard to compass. The search may comprise stepping around the full circle from one state to its adjacent neighbors. The directional coding supports the notion that high order bits define the "big" directions, and so changing high order bits moves the pattern in large increments. "Fine-tuning" is accomplished by the lower order bits. Antennas of different complexity may or may not use all of the bits—i.e., low-complexity antennas with relatively few discrete pattern states may respond only to the high order bits. More complex antennas may use all of the pattern-defining bits. Note that this application supports all of these modes, and the antenna directional control values do not need to be defined uniquely for antennas or control algorithms of different complexity.

In order to enable synchronization between the antenna 302 and receiver 310 and to enable turn-off of the digital signal when not needed, in various embodiments a "barker code" of up to 13 bits preceding the data bits, e.g., the 19 bits of control signal 700. If desired, another bit can be used to tell the antenna 302 that the next time slot is available for downstream transmission. A standard Manchester code, including parity bits if needed, meets these recommendations, and such a code also enables simple encoder and decoder designs.

Synchronization between antenna 302 and receiver 310 permits a known time slot for the downstream information bits, as identified above, to be sent from the antenna 302. The disclosed concept does not require that these bits be sent, and receiver algorithms can, and in various embodiments are, designed to be effective without them.

In various embodiments, there is a "wake-up" procedure, associated with communications between the antenna 302 and receiver 310. This is because, in general, the antenna's decoder's digital circuits will be OFF when the receiver 310 wants to initiate an antenna state change. One solution is for the receiver 310 to turn the antenna power OFF and then ON to signal a "power-on reset" that re-starts the antenna circuits' clock to allow synchronizing to the barker code.

The control bit stream, e.g., signal 700, is sent upon each channel change and under conditions where the receiver 310 determines that the error rate (or other measure of signal quality) is too poor. The bit stream continues to be sent until terminated by the receiver 310, e.g., upon successful antenna optimization.

Hardware for the communications link is simple, of complexity comparable to Manchester coders/decoders used in Ethernet cards.

The link described above can be carried on the co-axial cable between the antenna and receiver 310 that also carries the RF signals. As described the serial bit stream is separable in frequency from the RF signals, and it contains no DC, thus enabling provision of DC power to the antenna on the same co-ax cable. Alternatively, a separate 2-, 3- or 4-wire physical interfaces could carry the power, control and antenna information signals.

If a co-axial cable is the interface where backwards compatibility is a concern, then the antenna 302 should form a dipole or other simple pattern in the event that it is plugged into a "legacy", e.g., NTSC receiver, incapable of supporting the control signals of the present invention.

In accordance with the invention, multiple antennas may be used. This is particularly beneficial in mobile applications where the optimum antenna pattern position may vary frequently due to movement of the device in which the antenna is housed. In such an embodiment, while one antenna has its antenna pattern position adjusted, e.g., to maximize signal reception, the other antenna is used to receive information. Switching between the two antennas is used to maximize signal reception without the loss of signal reception during periods when the antenna pattern position is adjusted which might occur if a single antenna were used.

Figure 8:
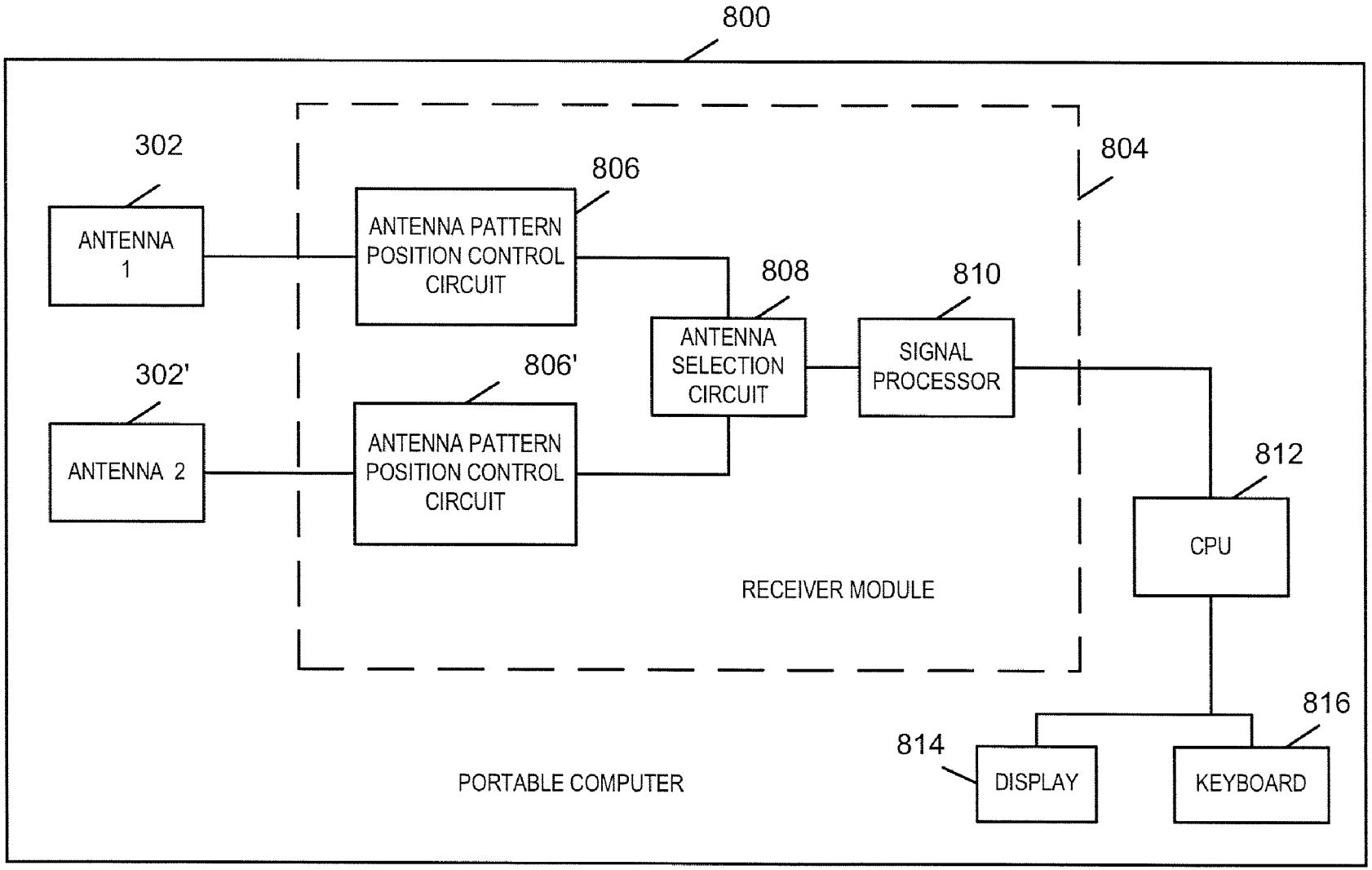
FIG. 8 illustrates a portable computer system using multiple antennas in accordance with a mobile embodiment of the present invention.

FIG. 8 illustrates a mobile system 800 implemented in accordance with a mobile embodiment of the present invention. The system 800 maybe, e.g., notebook computer, personal data assistant (PDA) or even a cell phone. Two antennas modules 302, 302' are used to allow adjustment of one antenna position pattern in accordance with the invention while the other antenna 302 or 302' is used to receive information, e.g., data or other signals. Each of the antennas 302, 302' is coupled to a receiver module 804. The receiver module 804, in turn, is coupled to a central processing unit (CPU) 812. The central processing unit (CPU) 812 is coupled to input/output devices, e.g., display 814 and keyboard 816. The CPU 812 receives information, e.g., data or other signals, from the receiver module 804 which is processed and/or displayed on the display 814.

The receiver module 804 includes two antenna pattern position control circuits 806, 806' which are used to direct, e.g., control, the position of the antenna patterns of antennas 302, 302' in accordance with the invention. The circuits 806. 806' may, but need not, include full demodulators. Antenna selection circuit 808 is coupled to a each of the antenna pattern position control circuits 806, 806' and selects between the antenna outputs from each of these circuits. In this manner, the signal from one of the antennas 302, 302' will be supplied to signal processor 810 at any given time. Signal processor 810 is responsible for decoding the received signal prior to supplying it to CPU 812.

By adjusting the position of one of the antenna patterns corresponding to antennas 302, 302' at a time while using the output of the other antenna 302, 302' as the input to the signal processor 810, signal antenna pattern position adjustments can be continually made without interfering with signal reception.

While FIG. 8 illustrates selecting between the output of two antennas with adjustable antenna patterns, in various embodiments of the present invention multiple, e.g., four or more, antennas with different fixed antenna patterns are used. In one such embodiment each antenna pattern has at least one high gain region and one low gain, e.g., null, region with the orientation of each antenna pattern relative to the receiver device being different. Multiple identical antennas, e.g., each having the same antenna pattern, e.g., the antenna pattern illustrated in FIG. 2, mounted with different orientations may be used in such an embodiment.

In accordance with the invention, the output of one of the plurality of antennas is selected, as a function of a signal, e.g., noise measurement, to be used at any given time. For example, the antenna output with the lowest signal to noise ratio may be selected to be demodulated and displayed. In this manner, an antenna with a pattern having a null aligned with a signal interference source may be preferred over another antenna which has a greater received signal strength but also more interference. In this manner, a device can obtain the benefit of selecting an antenna pattern with a signal interference source located in an antenna pattern null without having to use antenna's with steerable patterns or the control circuitry associated therewith.

By using the antenna pattern adjustment techniques and/or by selecting between the outputs of a plurality of antennas with low gain regions located at different positions, broadband and other wireless communications are supported in portable devices in accordance with the invention.

Numerous variations on the above described embodiments of the present invention are possible without departing from the scope of the invention. For example, a general purpose processor, e.g., CPU, may be programmed to perform antenna control signal decoding operations in addition to antenna control operations. In one such embodiment the decoder/control logic 404 is implemented using a CPU and memory which stores the software used to control the CPU to perform the decoding and control operations.

What is claimed is:

1. A method of supporting communications in a portable device, the method comprising:

providing a plurality of antennas, each of said plurality of antennas supporting adjustable antenna pattern positions;

receiving and decoding a signal using a first one of said plurality of antennas while adjusting the antenna pattern position of a second one of said plurality of antennas during a first period of time; and receiving and decoding a signal using the second one of said plurality of antennas while adjusting the antenna pattern position of the first one of said plurality of antennas during a second period of time.

2. The method of claim 1, wherein the first and second periods of time are immediately consecutive periods of time.

3. The method of claim 1, wherein said signal is a broadband communications signal.

4. The method of claim 1, further comprising, at the end of the first period of time, the step of:

operating a switching device to disconnect an output of the first antenna to a signal processor and to connect the output of the second antenna to the signal processor.

5. The method of claim 1, further comprising:

operating an antenna selection circuit to select the output of a single one of said plurality of antennas for decoding at any given point in time, said antenna selection circuit selecting the output of the first one of said plurality of antennas during said first period of time.

6. The method of claim 1, further comprising:

operating an antenna pattern position control circuit to adjust the antenna pattern position of the second one of said plurality of antennas during the first period of time while the antenna pattern on the first one of said plurality of antennas is held constant.

7. The method of claim 1, wherein the first and second antennas are separate independent antennas; and wherein the output of the second one of said plurality of antennas is not decoded while the output of the first one of said plurality of antennas is decoded.

8. A system for supporting communications in a portable device, the system comprising:

a plurality of antennas, each of said plurality of antennas supporting adjustable antenna pattern positions; and means for receiving and decoding a signal using a first one of said plurality of antennas while adjusting the antenna pattern position of a second one of said plurality of antennas during a first period of time and for receiving and decoding the signal using the second one of said plurality of antennas while adjusting the antenna pattern position of the first one of said plurality of antennas during a second period of time.

9. The system of claim 8, wherein the first and second periods of time are immediately consecutive periods of time.

10. The system of claim 8, wherein said signal is a broadband communications signal.

11. The system of claim 8, wherein said means includes a switching device coupled to a signal processor, the switching device being configured to connect an output of the first antenna to the signal processor during the first period of time and to connect the output of the second antenna to the signal processor during the second period of time.

* * * * *